US008368635B2

(12) United States Patent
Nakayama

(10) Patent No.: US 8,368,635 B2
(45) Date of Patent: Feb. 5, 2013

(54) SOURCE DRIVER FOR LIQUID CRYSTAL DISPLAY PANEL

(75) Inventor: Akira Nakayama, Chiba (JP)

(73) Assignee: Lapis Semiconductor Co., Ltd. (JP)

( * ) Notice: Subject to any disclaimer, the term of this patent is extended or adjusted under 35 U.S.C. 154(b) by 129 days.

(21) Appl. No.: 13/064,502

(22) Filed: Mar. 29, 2011

(65) Prior Publication Data

US 2011/0242084 A1 Oct. 6, 2011

(30) Foreign Application Priority Data

Mar. 30, 2010 (JP) ..... 2010-079310

(51) Int. Cl.
*G09G 3/36* (2006.01)

(52) U.S. Cl. ..... 345/100; 345/98

(58) Field of Classification Search ..... 345/98, 345/100

See application file for complete search history.

(56) References Cited

U.S. PATENT DOCUMENTS 6,529,180 B1 * 3/2003 Ito et al. ..... 345/89
6,661,402 B1 * 12/2003 Nitta et al. ..... 345/99
7,196,679 B2 * 3/2007 Jang et al. ..... 345/60

FOREIGN PATENT DOCUMENTS

JP 2003-060453 A 2/2003
JP 2005-201974 A 7/2005

* cited by examiner

*Primary Examiner* — Kevin M Nguyen
*Assistant Examiner* — Sepideh Ghafari
(74) *Attorney, Agent, or Firm* — Rabin & Berdo, P.C.

(57) ABSTRACT

A source driver for a liquid crystal display (LCD) panel in which during a first predetermined period immediately after polarity of a voltage according to image data is inverted, each column terminal of the LCD panel is shorted to a common line through an output terminal and a second switch element, a first output amplifying portion is set to a high impedance state, and an output signal of a second output amplifying portion is fed back to a differential amplifying portion through a third switch element. During a period after the first predetermined period and before inversion of polarity of a voltage according to the image data, an output signal of the first output amplifying portion is supplied to the output terminal without passing though a switch element, and is fed back to the differential amplifying portion through a fourth switch element. The output signal of the second output amplifying portion is fed back to the differential amplifying portion through the first and fourth switch elements.

7 Claims, 8 Drawing Sheets

SWING PERIOD

CS PERIOD

STABLE PERIOD

SOURCE DRIVER FOR LIQUID CRYSTAL DISPLAY PANEL

BACKGROUND OF THE INVENTION

1. Field of the Invention

The present invention relates to a source driver for an active matrix liquid crystal display panel.

2. Description of the Related Art

It is known that AC driving is required to guarantee long-term reliability of a Liquid Crystal Display (LCD) panel by preventing properties of LCD materials of the LCD panel from being degraded. Accordingly, in a conventional active matrix LCD device, a drive voltage according to a gray level of image data is supplied by a source driver between the electrodes of an LCD element of each cell (pixel) of an LCD panel, and the polarity of this drive voltage is inverted, for example, every frame of an image signal with respect to a reference potential (refer to Japanese Laid-open Patent Application No. 2005-201974). For example, if a drive voltage of an H (high potential) side relative to the reference potential is supplied in a frame, a drive voltage of an L (low potential) side relative to the reference potential is supplied in the next frame.

Instead of simultaneously setting all cells of the LCD panel to a drive voltage of the same side with respect to the reference potential, a dot inversion driving scheme or a 2-line dot inversion driving scheme is used. In the dot inversion driving scheme, neighboring cells in rows and columns have drive voltages of opposite sides with respect to the reference potential. In the 2-line dot inversion scheme, neighboring cells in columns have drive voltages of opposite sides and neighboring cells in rows have drive voltages inverted every two lines.

FIG. 1 illustrates as a example a waveform of a signal supplied to one of a plurality of column terminals of a LCD panel from a source driver. A reference potential (VCOM) signal is a potential of one terminal of a two-terminal LCD element and is a constant DC voltage (for example, 6V). The VCOM signal typically has a potential corresponding to approximately ½ an output voltage of a driving power source. A drive voltage is inverted in polarity with respect to the VCOM signal at a line scan period (scan period per line) like a characteristic denoted by solid line AL in FIG. 1. A waveform denoted by dashed lines BL in FIG. 1 shows a drive voltage supplied to an LCD element through an adjacent column terminal in the dot inversion driving scheme. Although the drive voltage is a voltage according to a gray level of image data as described above, the drive voltage after inversion becomes constant (that is, becomes the same gray level value) in FIG. 1.

Recently, in an LCD device, high-speed operation is required for improved picture quality. For this requirement, it is necessary to charge an LCD element of an LCD panel at high write speed by a drive voltage according to a gray level indicted by image data. On the other hand, power consumption of the device or heating amount of the driver, which have trade-off relations with the high write speed, need to be decreased.

SUMMARY OF THE INVENTION

Therefore, the present invention has been made in view of the above problems, and it is an object of the present invention to provide a source driver for an LCD panel which can reduce generation of heat while performing a high-speed operation.

A source driver for a liquid crystal display panel according to the present invention comprises an inverting portion which inverts polarity of a voltage according to, image data with respect to a reference potential at a predetermined cyclic period for each column of an active matrix liquid crystal display (LCD) panel, and a plurality of amplifiers each having a voltage follower for outputting, at the predetermined cyclic period, a drive voltage to a column terminal of the LCD panel through an output terminal in accordance with an output voltage of the inverting portion, wherein each of the plurality of amplifiers includes, a differential amplifying portion having a non-inverting input for receiving the output voltage of the inverting portion, first and second output amplifying portions for inputting an output voltage of the differential amplifying portion as input voltages, a connecting portion for connecting between an output of the first output amplifying portion and the output terminal, a first switch element for turning on or off a connection between an output of the second output amplifying portion and the output terminal, a second switch element for turning on or off a connection between the output terminal and a common line for the plurality of amplifiers, a third switch for turning on or off a connection between the output of the second output amplifying portion and an inverting input of the differential amplifying portion, and a fourth switch element for turning on or off a connection between the output terminal and the inverting input of the differential amplifying portion, and wherein, during a first predetermined period immediately after the polarity of the voltage according to the image data is inverted by the inverting portion, the first output amplifying portion is set to a high impedance state, the first and fourth switch elements are set to an off state, and the second and third switch elements are set to an on state, and during an period after the first predetermined period is ended and before the polarity of the voltage according to the image data is inverted again by the inverting portion, the first output amplifying portion is set to an amplifier operation state, the first and fourth switch elements are set to an on state, and the second and third switch elements are set to an off state.

In the source driver of the present invention, a voltage supplied to the column terminal of the LCD panel from the output terminal can be rapidly changed to a desired drive voltage. Further, the generation of heat can be reduced and the drive voltage can be output to the LCD panel with a high degree of accuracy.

DETAILED DESCRIPTION OF THE INVENTION

Hereinafter, an exemplary embodiment of the present invention will be described with reference to the attached drawings.

Figure 2:
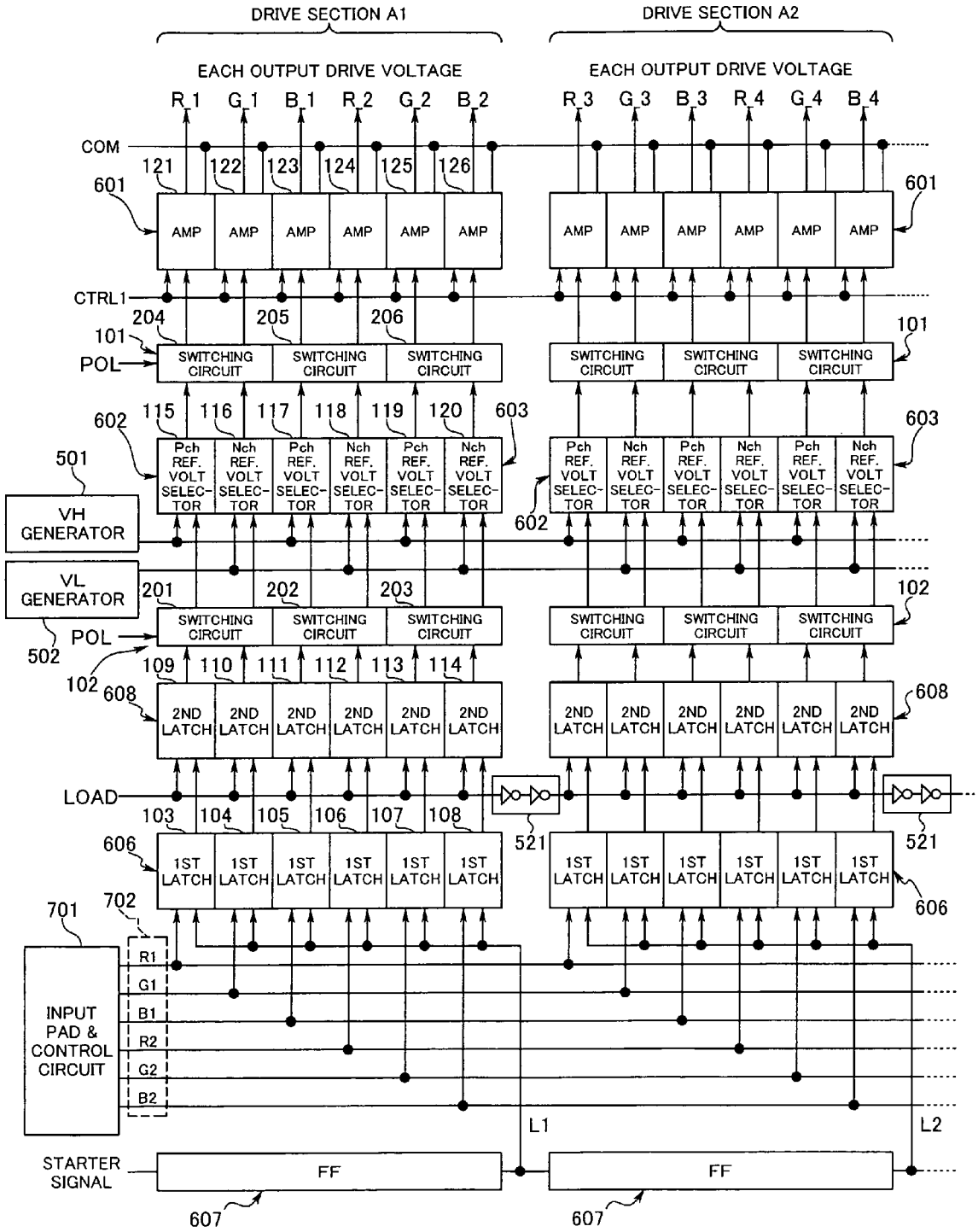
FIG. 2 is a block diagram illustrating a configuration of a source driver as a first exemplary embodiment of the present invention.

FIG. 2 illustrates a configuration of a source driver according to a first exemplary embodiment of the present invention. The source driver includes a plurality of amplifiers 601, a plurality of first switching circuits 102, a plurality of second switching circuits 101, a plurality of first latches 606, a plurality of second latches 608, shift registers 607, a plurality of P-channel reference voltage selectors 602, a plurality of N-channel reference voltage selectors 603, an input pad and control circuit 701, a VH generation circuit 501, a VL generation circuit 502, and a plurality of delay circuits 521.

The source driver has one drive section with respect to six adjacent columns of an active matrix LCD panel (not shown). FIG. 2 shows only two drive sections (a first drive section A1 and a second drive section A2). In six columns of each drive section, a driving group is formed by two neighboring columns. In two signal supply systems corresponding to two columns within each driving group, data and reference voltages are switched by the first and second switching circuits 102 and 101, as will be described later.

The shift registers 607 are comprised of a plurality of flip-flops (FFs) and output latch signals L1, L2, . . . indicating latch timings of data to the first latches 606 in accordance with a starter signal.

The input pad and control circuit 701 receives image data, rearranges the image data so that the first latches 606 may sequentially load the image data at the output timings of the shift registers 607, and supplies output image data 702 (R1, G1, B1, R2, G2, and B2) corresponding to six columns to the first latches 606.

Figure 3:
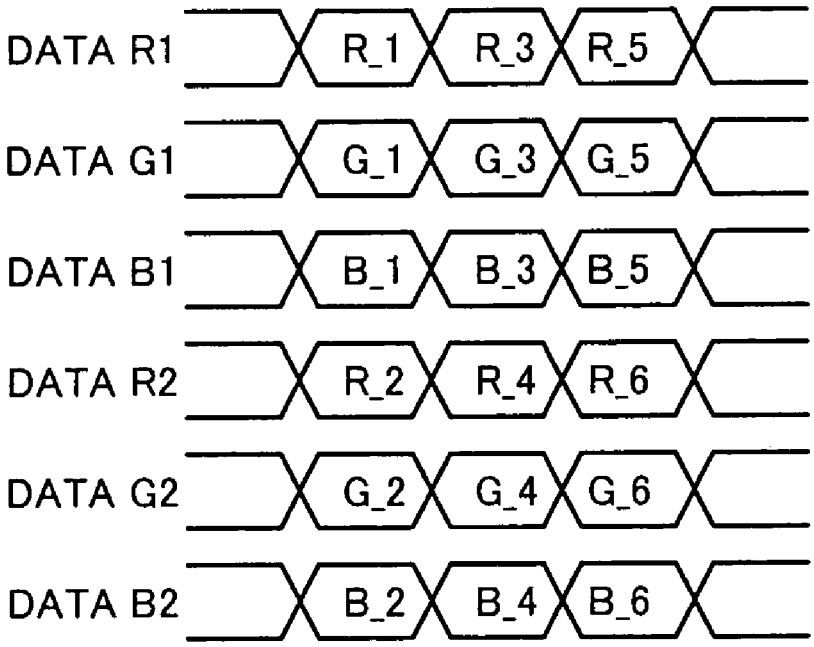
FIG. 3 is a diagram illustrating a structure of image data in FIG. 2.

The image data 702 simultaneously includes the data R1, G1, B1, R2, G2, and B2 corresponding to six columns as shown in FIG. 3. That is, the data R1, G1, B1, R2, G2, and B2 becomes R_1, G_1, B_1, R_2, G_2, and B_2 corresponding to the first six columns, becomes R_3, G_3, B_3, R_4, G_4, and B_4 corresponding to the next six columns, becomes R_5, G_5, B_5, R_6, G_6, and B_6 corresponding to the further next six columns. This pattern is then repeated.

The number of gray levels of the image data 702 is as follows. For example, 6-bit image data has 64 gray levels, 8-bit image data has 256 gray levels, and 10-bit image data has 1024 gray levels.

The number of the first latches 606 (103-108 in the case of the first drive section A1) is equal to the number of column terminals of an LCD panel. Each of the first latches 606 holds one of the image data 702 in accordance with the output timing signal L1, L2, . . . of the shift registers 607.

The number of the second latches 608 (109-114 in the case of the first drive section A1) is equal to the number of column terminals of the LCD panel. The second latches 608 latch the image data held to the first latches 606 in accordance with a load signal LOAD.

The first switching circuits 102 are half the column terminals in number (switching circuits 201 to 203 in the first drive section. A1). Each of the switching circuits 102 switches the destination of a signal, latched as data in the two second latches 608 that form one drive group, in response to a polarity inversion signal POL between the inputs of the P-channel reference voltage selector 602 and the N-channel reference voltage selector 603. Although FIG. 2 shows each switching circuit having two inputs and two outputs, each input and each output include input lines and output lines corresponding to the number of bits of a data signal. This 1-bit switching circuit has the same configuration as each switching circuit of the switching circuit 101 of FIG. 4 which will be described later.

The VH generation circuit 501 includes a plurality of voltage dividers each having one terminal to which a reference voltage VREF_H1 (12V) is supplied and the other terminal to which a reference voltage VREF_H2 (6V) is supplied. Each of the plurality of voltage dividers divides the supplied voltages to generate a plurality of different reference voltages VH corresponding to the number of gray levels of image data.

The VL generation circuit 502 includes a plurality of voltage dividers each having one terminal to which a reference voltage VREF_L1 (6V) is supplied and the other terminal to which a reference voltage VREF_L2 (0V) is supplied. Each of the plurality of voltage dividers divides the supplied voltages to generate a plurality of different reference voltages VL corresponding to the number of gray levels of image data.

The number of the P-channel reference voltage selectors 602 is half the number of column terminals of the LCD panel. Each of the P-channel reference voltage selectors 602 has a P-channel transistor. Each of the P-channel reference voltage selectors 602 selects one of the plurality of reference voltages VH in accordance with the data generated from the switching circuit 102 and supplies the selected reference voltage to the switching circuit 101. In the first drive section A1, reference numerals 115, 117, and 119 denote the P-channel reference voltage selectors.

The number of the N-channel reference voltage selectors 603 is half the number of column terminals of the LCD panel. Each of the N-channel reference voltage selectors 603 has an N-channel transistor. Each of the N-channel reference voltage selectors 603 selects one of the plurality of reference voltages VL in accordance with the data generated from the switching circuit 102 and supplies the selected reference voltage to the switching circuit 101. In the first drive section A1, reference numerals 116, 118, and 120 denote the N-channel reference voltage selectors.

Figure 4:
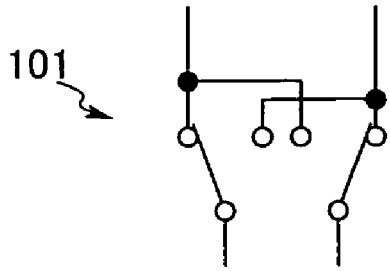
FIG. 4 is a diagram illustrating a configuration of a second switching circuit in the source driver of FIG. 2.

The second switching circuits 101 are half the column terminals in number (switching circuits 204 to 206 in the first drive section A1). Each of the switching circuits 101 exchanges the respective connections between the inputs of the two amplifiers 601, which form one drive group, and the outputs of the P-channel and N-channel reference voltage selectors 602 and 603. Each of the switching circuits 101 is comprised of two switches switched by a polarity inversion signal POL as shown in FIG. 4 and has two inputs and two outputs.

Each of the amplifiers 601 has a voltage follower for driving the LCD panel using a reference voltage generated from the switching circuit 101 as a drive voltage. The number of the amplifiers 601 is equal to the number of column terminals of the LCD panel. In the first drive section A1, the amplifier 601 is denoted by reference numerals 121-126. A control signal CTRL1 is supplied to the amplifiers 601 and a common line COM is connected to the amplifiers 601. An internal configuration of each of the amplifiers 601 will be described later. The common line COM is used to short output terminals of the amplifiers in the amplifier 601, that is, all column terminals of the LCD panel, during a CS period which will be described later.

The delay circuit 521 is provided between the driver sections described above. The delay circuit 521 delays the load signal LOAD and supplies the delayed load signal to the second latch 608 of the adjacent drive section to set a timing for transmitting image data to the second latch 608.

The above-described image data; starter signal, polarity inversion signal POL, load signal LOAD, and control signal CTRL1 are generated from a controller (not shown) in accordance with an image signal.

Figure 5:
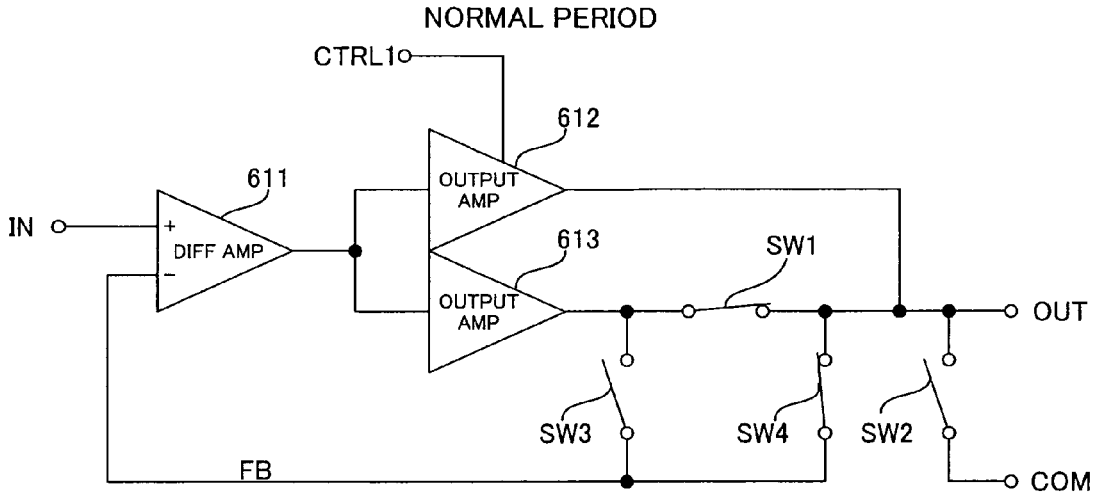
FIG. 5 is a circuit diagram illustrating a configuration of an amplifier in the source driver of FIG. 2.

Each amplifier of the amplifier 601 includes, as shown in FIG. 5, a differential amplifier 611 (differential amplifying portion), a first output amplifier 612 (first output amplifying portion), a second output amplifier 613 (second output amplifying portion), and switch elements SW1-SW4 (first to fourth switch elements), to constitute a voltage follower. The differential amplifier 611 and first and second output amplifiers 612 and 613 are comprised of Operational (OP) amplifiers. The first and second output amplifiers 612 and 613 are current amplifiers and the current output capacity of the first output amplifier 612 is greater than the current output capacity of the second output amplifier 613. That is, the first output amplifier 612 is a main amplifier having a large output current and the second output amplifier 613 is a sub amplifier having a small output current.

The reference voltage generated from the switching circuit 101 is supplied to a non-inverting input of the differential amplifier 611 through an input terminal IN, and a feedback signal FB of the voltage follower is supplied to an inverting input of the differential amplifier 611. An output of the differential amplifier 611 is connected to inputs of the first and second output amplifiers 612 and 613. The first and second output amplifiers 612 and 163 are connected in parallel with each other as output amplifiers. Such configuration of parallel connection is prior art which is disclosed in, for example, Japanese Laid-open Patent Application No. 2003-060453. An output of the first output amplifier 612 is connected to the output terminal OUT of the amplifier 601. The switch element SW1 is provided between an output of the second output amplifier 613 and the output terminal OUT. The switch element SW2 is provided between the output terminal OUT and the common line COM. The switch element SW3 is provided between the output of the second output amplifier 613 and the inverting input of the differential amplifier 611. The switch element SW4 is provided between the output terminal OUT and the inverting input of the differential amplifier 611.

The control signal CTRL1 is supplied to the first output amplifier 612. The first output amplifier 612 becomes one of an amplifier operation state and a high impedance state in accordance with the control signal CTRL1. Although not shown, the control signal CTRL1 is also supplied to the switch elements SW1-SW4. The switch elements SW1-SW4 are turned on or off in accordance with the control signal CTRL1. FIG. 5 shows an on or off (open or closed) state of the switch elements SW1-SW4 during a normal period. In FIG. 5, the switch elements SW1 and SW4 are in an on state and the switch elements SW2 and SW3 are in an off state.

Figure 1:
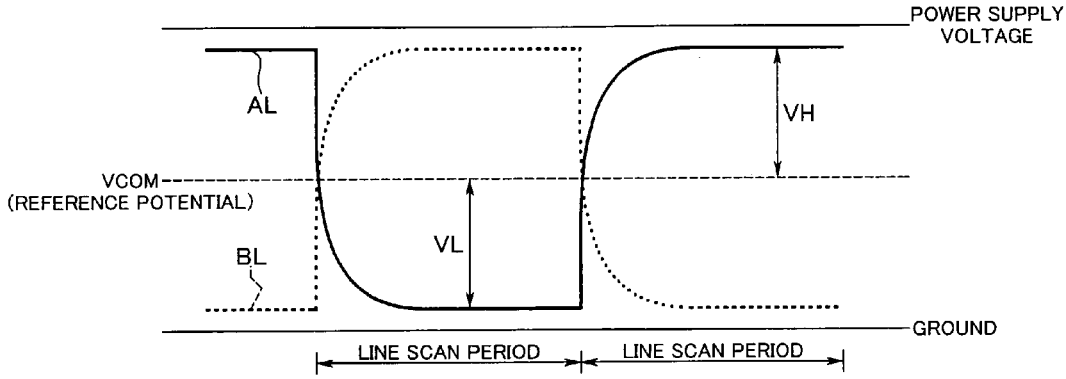
FIG. 1 is a diagram illustrating as an example a waveform of a signal supplied to one of a plurality of column terminals of an LCD panel from a conventional source driver.

The above-described LCD panel is illustrated, for example, in FIG. 1 of the first-mentioned patent document and the output terminal OUT of each amplifier of the amplifier 601 is connected to source lines S1-Sm illustrated in FIG. 1 of Japanese Laid-open Patent Application No. 2005-201974.

Figure 6:
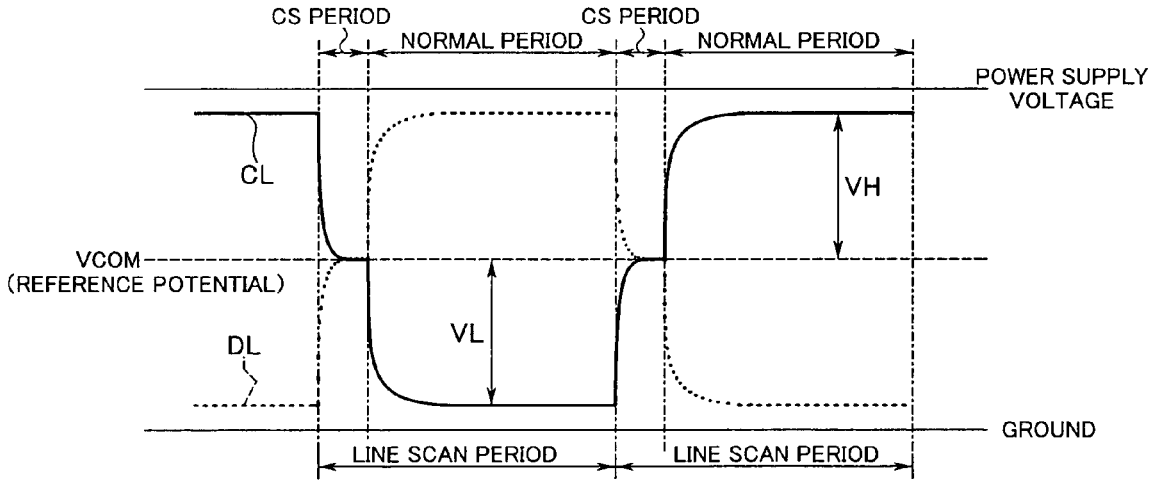
FIG. 6 is a diagram illustrating as an example a waveform of a signal supplied to one column terminal of an LCD panel from the source driver of FIG. 2.

In the above-described source driver, a drive voltage supplied to one column terminal of an LCD panel from the output terminal of the amplifier 601 varies, for example, as indicated by solid line CL in FIG. 6. The drive voltage becomes equal to a potential of a VCOM signal (reference potential) during the first Charge Sharing (CS) period (a first predetermined period) of each line scan period (predetermined cyclic period). The CS period is a period for redistributing charges charged in a capacitive component of an LCD element located on one line. During the CS period, the output terminal OUT of each amplifier of the amplifier 601 is shorted to the common line COM in accordance with the control signal CTRL1. During the remaining period after the CS period of the line scan period, the drive voltage becomes a voltage corresponding to a desired gray level and is inverted at the line scan period. A waveform indicated by dashed lines DL in FIG. 6 shows a drive voltage supplied to a column terminal adjacent to the above-described one column terminal. Although a drive voltage is a voltage according to a gray level of image data as described previously, the drive voltage shown in FIG. 6 becomes constant (the same gray level value) after inversion. The CS period has a time during which a voltage of a column terminal nearly reaches at least a potential of the VCOM signal.

The drive voltage supplied to each column terminal is inverted in polarity for each frame in accordance with the polarity inversion signal POL. That is, if the drive voltage is in a high level (H) side compared with the reference potential VCOM in one frame of an image signal, the drive voltage is in a low level (L) side compared with the reference potential VCOM in the next frame.

In the source driver of the above-described configuration, operation is described for the case where drive voltages by data of the first drive section A1 are sequentially changed to H, L, H, L, H, and L sides of the reference potential when the polarity inversion signal POL is a low level (L) and data R1, G1, B1, R2, G2, and B2 is R_1, G_1, B_1, R_2, G_2, and B_2, respectively.

By the latch signal L1 generated from the shift register 607, the data R_1, G_1, B_1, R_2, G_2, and B_2 are latched to the latches 103, 104, 105, 106, 107, and 108 of the first latch 606, respectively. Similarly, in data after the data R_1, G_1, B_1, R_2, G_2, and B_2, the input image data 702 is sequentially latched to the first latch 606 by a latch signal Ln (where n is 2 to the number of outputs/6) generated from the shift register 607.

After all the input image data according to the number of outputs is latched to the first latch 606, data of the first latches 103, 104, 105, 106, 107, and 108 are simultaneously transmitted to the second latches 109, 110, 111, 112, 113, and 114, respectively. Similarly, data of the first latch 606 after the first latch 108 is simultaneously transmitted to the second latch 608 sequentially every six columns by a signal Tn (where n is 2 to the number of outputs/6) obtained by delaying the load signal LOAD for each six columns (one drive section).

By the first switching circuit 201, data of the second latch 109 is input to the P-channel reference voltage selector 115 of the P-channel reference voltage selector 602 and data of the second latch 110 is input to the N-channel reference voltage selector 116 of the N-channel reference voltage selector 603. By the switching circuit 202, data of the second latch 111 is input to the P-channel reference voltage selector 117 and data of the second latch 112 is input to the N-channel reference voltage selector 118. By the switching circuit 203, data of the second latch 113 is input to the P-channel reference voltage selector 119 and data of the second latch 114 is input to the N-channel reference voltage selector 120. The plurality of reference voltages VH is supplied to the P-channel reference voltage selector 602 (that is, 115, 117, and 119) from the VH generation circuit 501, and the plurality of reference voltages VL is supplied to the N-channel reference selector 603 (that is, 116, 118, and 120) from the VL generation circuit 502.

Each of the P-channel reference voltage selectors 115, 117, and 119 selects one of the plurality of reference voltages VH, which is higher than the VCOM signal (reference potential), in accordance with input image data.

Each of the N-channel reference voltage selectors 116, 118, and 120 selects one of the plurality of reference voltages VL, which is lower than the VCOM signal (reference potential), in accordance with input image data.

The reference voltage VH selected from the P-channel reference voltage selector 115 is input to the amplifier 121 among the plurality of amplifiers 601 by the second switching circuit 204. The reference voltage VL selected from the N-channel reference voltage selector 116 is input to the amplifier 122 among the plurality of amplifiers 601 by the second switching circuit 204. The reference voltage VH selected from the P-channel reference voltage selector 117 is input to the amplifier 123 among the plurality of amplifiers 601 by the second switching circuit 205. The reference voltage VL selected from the N-channel reference voltage selector 118 is input to the amplifier 124 among the plurality of amplifiers 601 by the second switching circuit 205. The reference voltage VH selected from the P-channel reference voltage selector 119 is input to the amplifier 125 among the plurality of amplifiers 601 by the second switching circuit 206. The reference voltage VL selected from the N-channel reference voltage selector 120 is input to the amplifier 126 among the plurality of amplifiers 601 by the second switching circuit 206.

Figure 7:
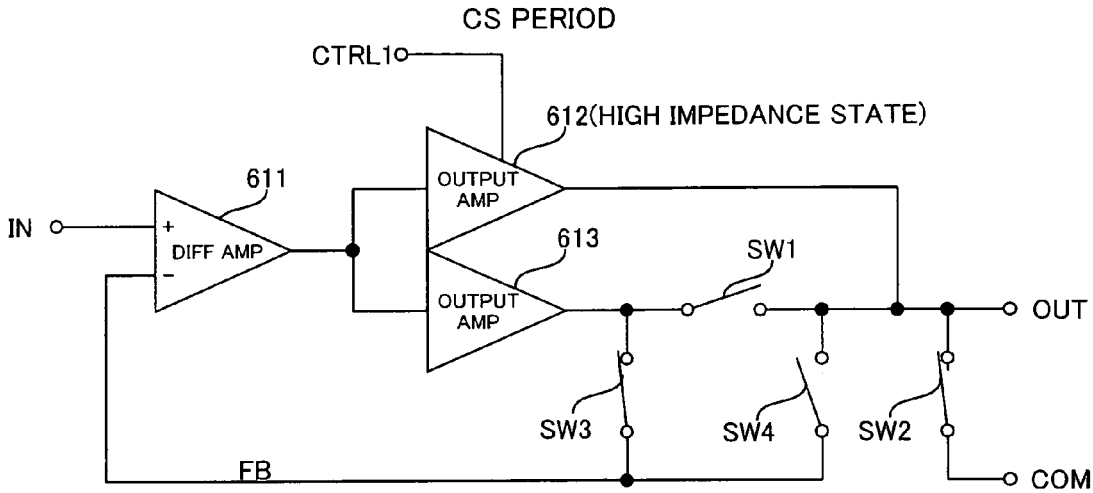
FIG. 7 is a circuit diagram illustrating an on/off state of each switch element and a high impedance state of a first output amplifier in the amplifier of FIG. 5 during a CS period.

A period during which the polarity inversion signal POL is a low level (L) is the CS period shown in FIG. 6. During the CS period, in each amplifier of the plurality of amplifiers 601, the switch elements SW1 and SW4 are turned off and the switch elements SW2 and SW3 are turned on as shown in FIG. 7. Since the first output amplifier 612 becomes a high impedance state, the first output amplifier 612 does not affect the output terminal OUT. Since each column terminal of the LCD panel is connected to the common line COM by the turned-on switch element SW2, a voltage of the output terminal OUT, that is, a voltage of the column terminal of the LCD panel gradually transitions to a potential of the VCOM signal. Meanwhile, during the CS period, the second output amplifier 613 operates as an amplifier and generates a voltage according to an output voltage of the differential amplifier 611. The generated voltage is supplied, as a feedback signal FB, to the inverting input of the differential amplifier 611 through the switch element SW3. Accordingly, the second output amplifier 613 generates a voltage according to the reference voltage VH or VL input to each amplifier of the amplifier 601.

If the CS period is ended, a normal period is started in each amplifier of the plurality of amplifiers 601. That is, the switch elements SW1 and SW4 are turned on and the switch elements SW2 and SW3 are turned off. The first and second output amplifiers 612 and 613 operate as an amplifier and output the same drive voltage to the output terminal OUT in accordance with the output voltage of the differential amplifier 611. An output drive voltage of the first output amplifier 612 is supplied, as the feedback signal FB, to the inverting input of the differential amplifier 611 through the switch element SW4. An output drive voltage of the second output amplifier 613 is supplied, as the feedback signal FB, to the inverting input of the differential amplifier 611 through the switch elements SW1 and SW4. Hence, a voltage of the output terminal OUT transitions to a desired drive voltage from a potential of the VCOM signal of the CS period. Since feedback of the output voltage of the second output amplifier 613 to the differential amplifier 611 is performed through a connection line of the output terminal OUT, the output voltage of the second output amplifier 613 of the CS period is directly incorporated in the drive voltage generated from the output terminal OUT and thus the voltage of the output terminal OUT may rapidly reach a desired drive voltage from the potential of the VCOM signal.

Thus, a drive voltage of an H side corresponding to the data R_1 is generated from the amplifier 121 in accordance with the reference voltage VH input to the amplifier 121 among the plurality of amplifiers 601. A drive voltage of an L side corresponding to the data G_1 is generated from the amplifier 122 in accordance with the reference voltage VL input to the amplifier 122 among the plurality of amplifiers 601. A drive voltage of an H side corresponding to the data B_1 is generated from the amplifier 123 in accordance with the reference voltage VH input to the amplifier 123 among the plurality of amplifiers 601. A drive voltage of an L side corresponding to the data R_2 is generated from the amplifier 124 in accordance with the reference voltage VL input to the amplifier 124 among the amplifiers 601. A drive voltage of an H side corresponding to the data G_2 is generated from the amplifier 125 in accordance with the reference voltage VH input to the amplifier 125 among the amplifiers 601. A drive voltage of an L side corresponding to the data B_2 is generated from the amplifier 126 in accordance with the reference voltage VL input to the amplifier 126 among the amplifiers 601.

Next, operation is described in the case where the polarity inversion signal POL transitions to a high level (H) and drive voltages by the data R_1, G_1, B_1, R_2, G_2, and B_2 of the first drive section A1 is respectively changed to L, H, L, H, L, and H sides of the reference potential.

In this case, since operation from the input image data 702 to the second latch 608 is the same as the operation described above, a description thereof is omitted. The switching circuits 101 and 102 are switched by the polarity inversion signal POL of a high level.

By the switching circuit 201 among the plurality of first switching circuits 102, data of the second latch 109 is input to the N-channel reference voltage selector 116 among the N-channel reference voltage selectors 603 and data of the second latch 110 is input to the P-channel reference voltage selector 115 among the p-channel reference voltage selectors 602. By the switching circuit 202, data of the second latch 111 is input to the N-channel reference voltage selector 118 and data of the second latch 112 is input to the P-channel reference voltage selector 117. By the switching circuit 203, data of the second latch 113 is input to the N-channel reference voltage selector 120 and data of the second latch 114 is input to the P-channel reference voltage selector 119.

Each of the P-channel reference voltage selectors 115, 117, and 119 selects one of the plurality of reference voltages VH, which is higher than the VCOM signal (reference potential), in accordance with input image data.

Each of the N-channel reference voltage selectors 116, 118, and 120 selects one of the plurality of reference voltages VL, which is lower than the VCOM signal (reference potential), in accordance with input image data.

The reference voltage VH generated from the P-channel reference voltage selector 115 is input to the amplifier 122 among the amplifiers 601 by the second switching circuit 204. The reference voltage VL generated from the N-channel reference voltage selector 116 is input to the amplifier 121 among the amplifiers 601 by the second switching circuit 204. The reference voltage VH generated from the P-channel reference voltage selector 117 is input to the amplifier 124 among the amplifiers 601 by the second switching circuit 205. The reference voltage VL generated from the N-channel reference voltage selector 118 is input to the amplifier 123 among the amplifiers 601 by the second switching circuit 205. The reference voltage VH generated from the P-channel reference voltage selector 119 is input to the amplifier 126 among the amplifiers 601 by the second switching circuit 206. The reference voltage VL generated from the N-channel reference voltage selector 120 is input to the amplifier 125 among the amplifiers 601 by the second switching circuit 206.

A period during which the polarity inversion signal POL is a high level (H) is a CS period shown in FIG. 6. During the CS period, in each amplifier of the plurality of amplifiers 601, the switch elements SW1 and SW4 are turned off and the switch elements SW2 and SW3 are turned on as shown in FIG. 7. The first output amplifier 612 becomes a high impedance state and the same operation as the operation during the CS period when POL=L is performed. Since each column terminal of the LCD panel is connected to the common line COM by the switch element SW2 of an on state, a voltage of the output terminal OUT, that is, a voltage of a column terminal of the LCD panel gradually transitions to a potential of the VCOM signal. Meanwhile, during the CS period, the second output amplifier 613 operates as an amplifier and generates a voltage in accordance with an output voltage of the differential amplifier 611. The generated voltage is supplied, as the feedback signal FB, to the inverting input of the differential amplifier 611 through the switch element SW3. Accordingly, the second output amplifier 613 generates a voltage according to the reference voltage VH or VL input to each of the amplifiers 601.

If the CS period is ended, a normal period is started in each amplifier of the plurality of amplifiers 601 like the case of POL=L. That is, the switch elements SW1 and SW4 are turned on and the switch elements SW2 and SW3 are turned off. The first and second output amplifiers 612 and 613 operate as an amplifier and output the drive voltage to the output terminal OUT in accordance with an output voltage of the differential amplifier 611. An output voltage of the first output amplifier 612 is supplied, as the feedback signal FB, to the inverting input of the differential amplifier 611 through the switch element SW4. An output voltage of the second output amplifier 613 is supplied, as the feedback signal FB, to the inverting input of the differential amplifier 611 through the switch elements SW1 and SW4. Hence, a voltage of the output terminal OUT rapidly transitions to a desired drive voltage from a potential of the VCOM signal of the CS period. Thus, a drive voltage of an H side corresponding to the data G_1 is generated from the amplifier 122 in accordance with the reference voltage VH input to the amplifier 122 among the plurality of amplifiers 601. A drive voltage of an L side corresponding to the data R_1 is generated from the amplifier 121 in accordance with the reference voltage VL input to the amplifier 121 among the amplifiers 601. A drive voltage of an H side corresponding to the data R_2 is generated from the amplifier 124 in accordance with the reference voltage VH input to the amplifier 124 among the amplifiers 601. A drive voltage of an L side corresponding to the data B_1 is generated from the amplifier 123 in accordance with the reference voltage VL input to the amplifier 123 among the amplifiers 601. A drive voltage of an H side corresponding to the data B_2 is generated from the amplifier 126 in accordance with the reference voltage VH input to the amplifier 126 among the amplifiers 601. A drive voltage of an L side corresponding to the data G_2 is generated from the amplifier 125 in accordance with the reference voltage VL input to the amplifier 125 among the amplifiers 601.

Figure 8:
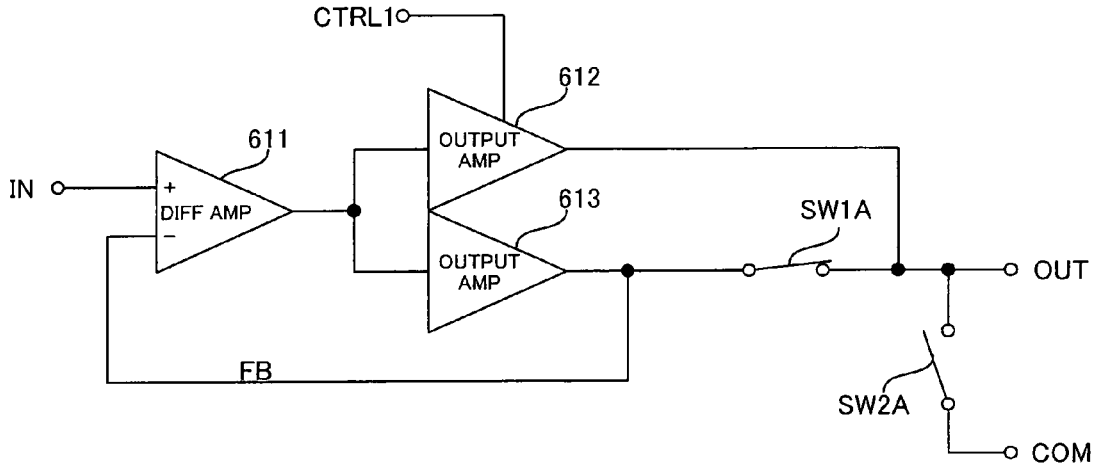
FIG. 8 is a circuit diagram illustrating another example of the amplifier.

If each of the amplifiers 601 is constructed including only two switch elements SW1A and SW2A as switch elements, for example, as shown in FIG. 8, during the CS period, the first output amplifier 612 becomes a high impedance state, the switch element SW1A is turned off, and the switch element SW2A is turned on. Meanwhile, during the normal period, the switch element SW1A is turned on and the switch element SW2A is turned off. In FIG. 8, since an output signal of the second output amplifier 613 is fed back to the differential amplifier 611 without passing through the switch element SW1A during the normal period, there is an influence by a delay of the switch element SW1A until the output voltage of the second output amplifier 613 obtained during the CS period is incorporated in the output terminal OUT. On the contrary, according to the first embodiment, the switch element SW3 is provided between the second output amplifier 613 side of the switch element SW1 and the feedback signal FB line, and the switch element SW4 is provided between the output terminal OUT and the feedback signal FB line. Therefore, since the output voltage of the second output amplifier 613 obtained during the CS period is immediately output to the output terminal OUT during the normal period, there may be no influence of a signal delay caused by the switch element SW1.

In the configuration of FIG. 8, since the output signal of the first output amplifier 612 having a large amount of output current flows into the switch element SW1A as a feedback signal during the normal period, it is necessary to increase the size of the switch element SW1A. On the contrary, according to the first embodiment, since only the output current of the second output amplifier 613 flows into the switch element SW1 corresponding to the switch element SW1A of FIG. 8, little heat is generated and the size of the switch SW1 may be decreased. As a result, the size of the latch of the source driver may be reduced.

Figure 9:
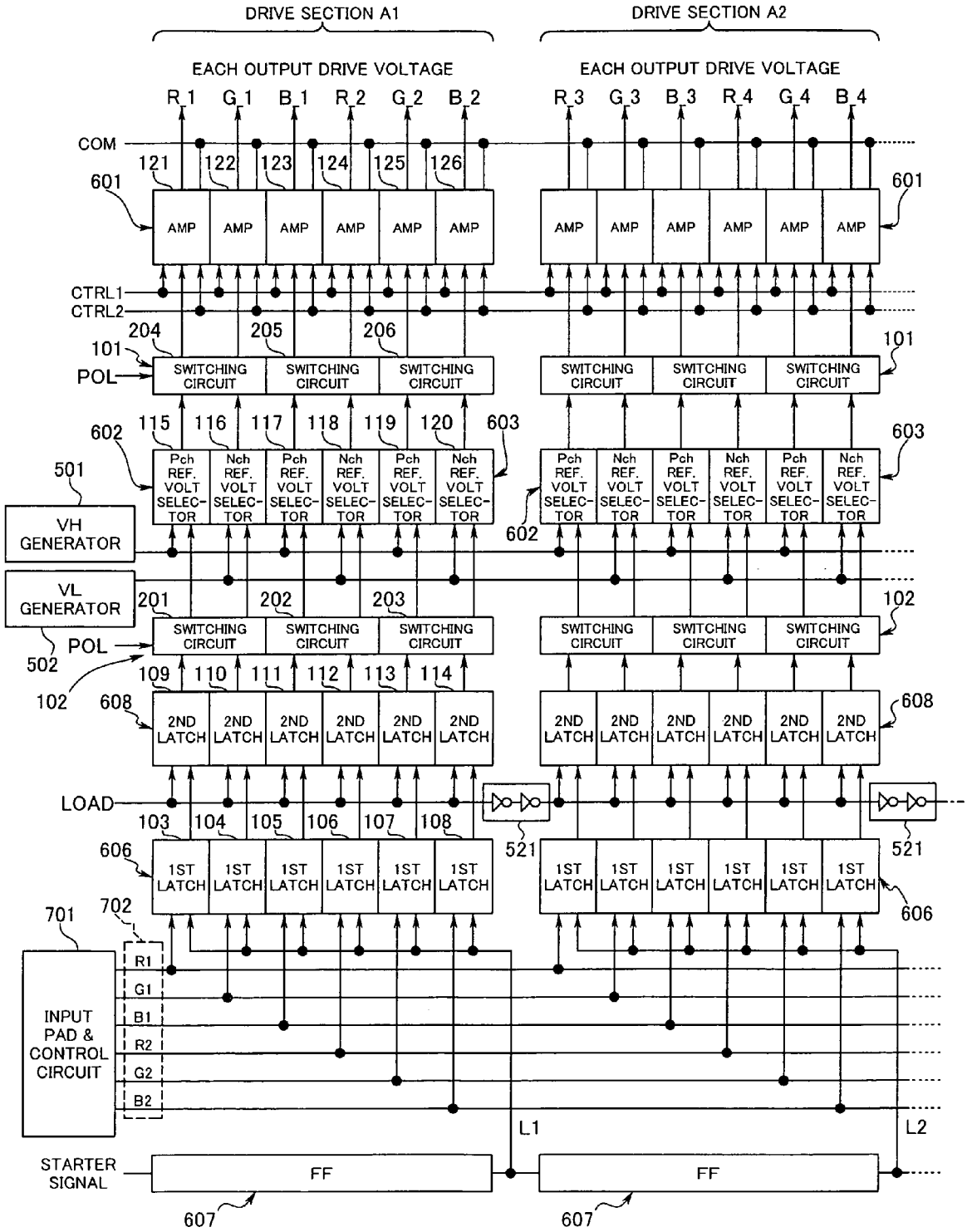
FIG. 9 is a block diagram illustrating a configuration of a source driver as a second exemplary embodiment of the present invention.
Figure 10:
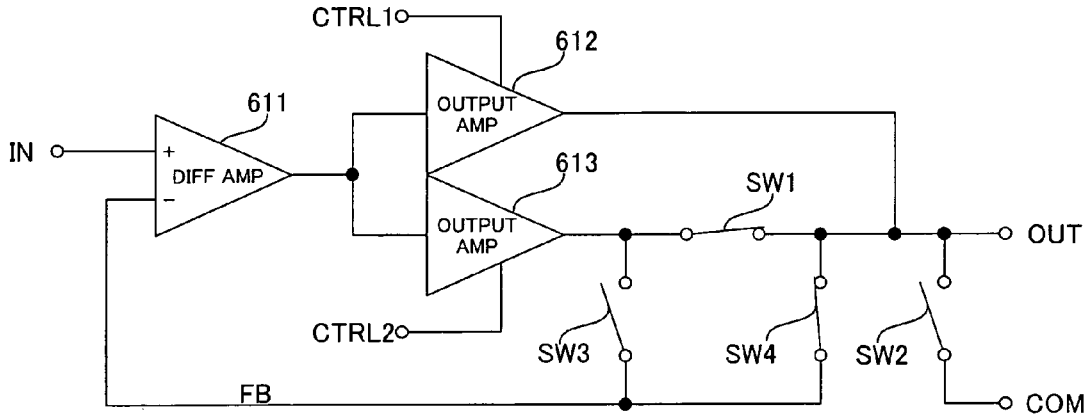
FIG. 10 is a circuit diagram illustrating a configuration of an amplifier in the source driver of FIG. 9.

FIG. 9 illustrates a configuration of a source driver according to a second exemplary embodiment of the present invention, and FIG. 10 illustrates a configuration of each amplifier 601 in the source driver.

In the source driver of FIG. 9, not only a control signal CTRL1 but also a control signal CTRL2 is supplied to amplifiers 121 to 126 of the amplifiers 601. The other configuration is the same as the source driver of FIG. 2.

Each of the amplifiers 601 includes, as shown in FIG. 10, a differential amplifier 611, a first output amplifier 612, a second output amplifier 613, and switch elements SW1 to SW4, to constitute a voltage follower.

The control signal CTRL1 is supplied to the first output amplifier 612 and the first output amplifier 612 becomes one of an amplifier operation state and a high impedance state in accordance with the control signal CTRL1. The control signal CTRL2 is supplied to the second output amplifier 613 and the second output amplifier 613 becomes one of an amplifier operation state and a high impedance state in accordance with the control signal CTRL2. Like the configuration of the first embodiment of FIG. 5, the switch elements SW1 to SW4 are turned on or off in accordance with the control signal CTRL1.

Figure 11:
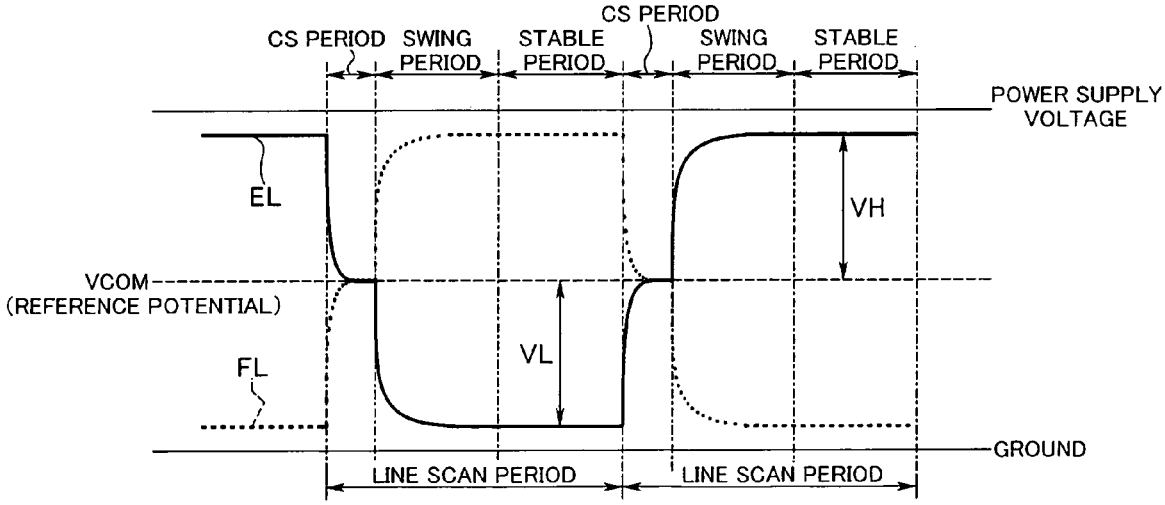
FIG. 11 is a diagram illustrating as an example a waveform of a signal supplied to one column terminal of an LCD panel from the source driver of FIG. 9.

In the source driver of FIGS. 9 and 10, operation of the amplifier 601 has a CS period (first predetermined period), a swing period (second predetermined period), and a stable period in a line scan period. A drive voltage supplied to one column terminal of an LCD panel from an output terminal of the amplifier 601 varies, for example, as indicated by solid line EL in FIG. 11. During the CS period, the drive voltage is the same as a potential of a VCOM signal (reference voltage). During the CS period, an output terminal OUT of each amplifier of the amplifier 601 is shorted to a common line COM in accordance with the control signal CTRL1. A waveform indicated by dashed lines FL in FIG. 11 shows a drive voltage supplied to an LCD element through an adjacent column terminal in a dot inversion driving scheme.

Figure 12:
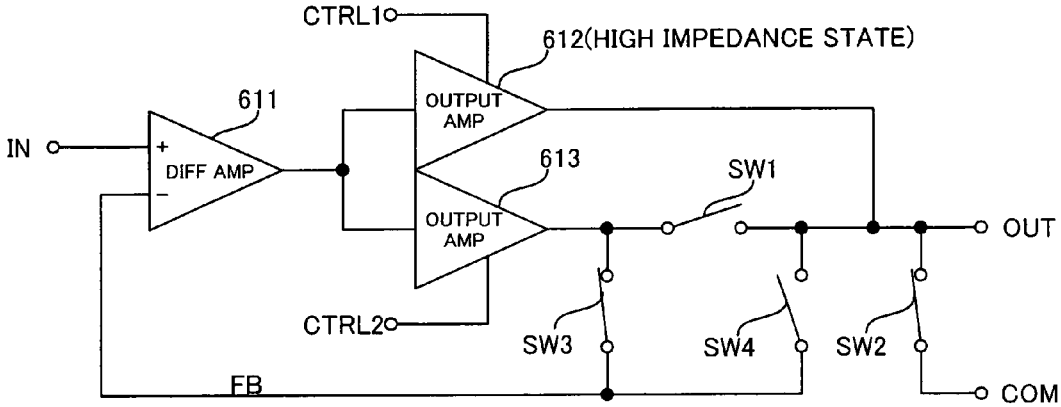
FIG. 12 is a circuit diagram illustrating an on/off state of each switch element and a high impedance state of a first output amplifier in the amplifier of FIG. 10 during a CS period.

During the CS period, in the amplifier 601, the switch elements SW1 and SW4 are turned off and the switch elements SW2 and SW3 are turned on in accordance with the control signal CTRL1, as shown in FIG. 12. The first output amplifier 612 becomes a high impedance state. Since each column terminal of an LCD panel is connected to the common line COM by the switch element SW2 of an on state, a voltage of the output terminal OUT, that is, a voltage of a terminal of each LCD element located on the same line of the LCD panel gradually reaches a potential of a VCOM signal. Meanwhile, during this CS period, the second output amplifier 613 operates an amplifier and generates a voltage in accordance with an output voltage of the differential amplifier 611. The generated voltage is supplied, as a feedback signal FB, to an inverting input of the differential amplifier 611 through the switch element SW3. Accordingly, the second output amplifier 613 generates a voltage according to the reference voltage VH or VL input to each amplifier of the amplifier 601.

If the CS period is ended and the swing period is started, the switch elements SW1 and SW4 are turned on and the switch elements SW2 and SW3 are turned off in accordance with the control signal CTRL1 as shown in FIG. 10. The first and second output amplifiers 612 and 613 become an amplifier operation state and generate voltages in accordance with the output voltage of the differential amplifier 611. The output voltage of the first output amplifier 612 is supplied, as a feedback signal FB, to the inverting input of the differential amplifier 611 through the switch element SW4. The output voltage of the second output amplifier 613 is supplied, as the feedback signal FB, to the inverting input of the differential amplifier 611 through the switch elements SW1 and SW4. The output voltages of the first and second output amplifiers 612 and 613 are added to generate a drive voltage which is output to a column terminal of the LCD panel through the output terminal OUT. This drive voltage rapidly varies by the output voltage of the second output amplifier 613 of the CS period and reaches a desired voltage (voltage corresponding to an input reference voltage) from a potential of the VCOM signal.

Figure 13:
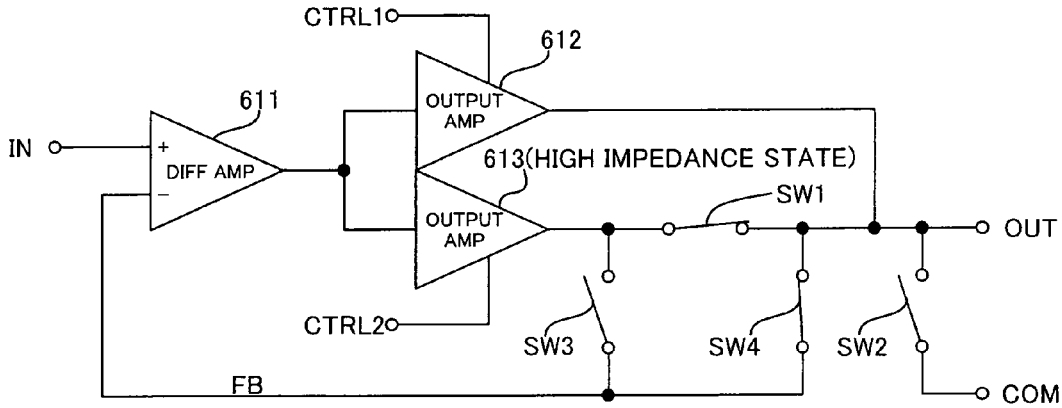
FIG. 13 is a circuit diagram illustrating an on/off state of each switch element and a high impedance state of a second output amplifier in the amplifier of FIG. 10 during a normal period.

After the drive voltage reaches a desired voltage according to image data, each of the amplifiers 601 transitions to the stable period. As shown in FIG. 13, the second output amplifier 613 becomes a high impedance state in accordance with the control signal CTRL2. The state of the switch elements SW1 to SW4 and the first output amplifier 612 is the same as the state during the swing period. Since a drive voltage is at a desired stable voltage during the stable period, only the first output amplifier 612, which is a main amplifier, becomes an amplifier operation state and generates the drive voltage.

According to the second embodiment, the switch element SW3 is provided between the second output amplifier 613 side of the switch element SW1 and the feedback signal FB line, and the switch element SW4 is provided between the output terminal OUT and the feedback signal FB line. Therefore, since the output voltage of the second output amplifier 613 obtained during the CS period is immediately incorporated as the drive voltage to the output terminal OUT of the swing period, there may be no influence of signal delay caused by the switch element SW1. Since only the output current of the second output amplifier 613 flows into the switch element SW1, little heat is generated and the size of the switch SW1 may be decreased. As a result, a chip size of the source driver may be reduced.

Furthermore, according to the second embodiment, since the second output amplifier 613 transitions to a high impedance state at a time that the drive voltage is stable in accordance with the control signal CTRL2, normal current flowing into the amplifier 601 is reduced, thereby reducing power consumption.

The above embodiments have described the case where 9V is selected by the P-channel reference voltage selector from among a plurality of reference voltages VH and 3V is selected by the N-channel reference voltage selector from among a plurality of reference voltages VL. However, the same effect may be obtained even when other reference voltages VH and VH are selected. Moreover, the present invention may be applied even when the reference voltages VH and VL supplied to the amplifier 601 before and after the switching of the polarity inversion signal POL vary. The reference voltages VREF_H1 and VREF_H2 used for generating the plurality of reference voltages VH in the VH generation circuit 501 are not restricted to 12V and 6V and other voltage values may be used. Similarly, the reference voltages VREF_L1 and VREF_L2 used for generating the plurality of reference voltages VL in the VL generation circuit 502 are not restricted to 6V and 0V and other voltage values may be used.

The source driver of the present invention may be formed of a semiconductor integrated circuit, that is, a semiconductor chip. As the switch elements SW1 to SW4, at least two Field Effect Transistors (FETs) may be constructed by parallel connection. As the first and second output amplifiers 612 and 163, a plurality of FETs may be constructed with gates arranged in a comb shape. Current output capacity is determined by the number of combs, that is, the number of transistors by constantly setting the gate lengths and gate widths of the FETs, and the number of transistors of the first output amplifier 612 having a large output current is greater than the number of transistors of the second output amplifier 613. In the above-described embodiments, although the first output amplifier 612 has greater current output capacity than the second output amplifier 613, they may have the same current output capacity.

This application is based on Japanese Application No. 2010-079310, which is incorporated herein by reference.

What is claimed is:

1. A source driver comprising:

an inverting portion which inverts polarity of a voltage according to image data with respect to a reference potential at a predetermined cyclic period for each column of an active matrix liquid crystal display (LCD) panel; and a plurality of amplifiers each having a voltage follower for outputting, at the predetermined cyclic period, a drive voltage to a column terminal of the LCD panel through an output terminal in accordance with an output voltage of the inverting portion, wherein each of the plurality of amplifiers includes, a differential amplifying portion having a non-inverting input for receiving the output voltage of the inverting portion, first and second output amplifying portions for inputting an output voltage of the differential amplifying portion as input voltages, a connecting portion for connecting between an output of the first output amplifying portion and the output terminal, a first switch element for turning on or off a connection between an output of the second output amplifying portion and the output terminal, a second switch element for turning on or off a connection between the output terminal and a common line for the plurality of amplifiers, a third switch for turning on or off a connection between the output of the second output amplifying portion and an inverting input of the differential amplifying portion, and a fourth switch element for turning on or off a connection between the output terminal and the inverting input of the differential amplifying portion, and wherein, during a first predetermined period immediately after the polarity of the voltage according to the image data is inverted by the inverting portion, the first output amplifying portion is set to a high impedance state, the first and fourth switch elements are set to an off state, and the second and third switch elements are set to an on state, and during an period after the first predetermined period is ended and before the polarity of the voltage according to the image data is inverted again by the inverting portion, the first output amplifying portion is set to an amplifier operation state, the first and fourth switch elements are set to an on state, and the second and third switch elements are set to an off state.

2. The source driver of claim 1, wherein, during the first predetermined period immediately after the polarity of the voltage according to the image data is inverted, the first output amplifying portion is set to a high impedance state, the second output amplifying portion is set to an amplifier operation state, the first and fourth switch elements are set to an off state, and the second and third switches are set to an on state, during a second predetermined period after the first predetermined period is ended, the first and second output amplifying portion are set to an amplification operation state, the first and fourth switch elements are set to an on state, and the second and third switch elements are set to an off state, and during an period after the second predetermined period is ended and before the polarity of the voltage according to the image data is inverted again by the inverting portion, the first output amplifying portion is set to an amplifier operation state, the second output amplifying portion is set to a high impedance state, the first and fourth switch elements are set to an on state, and the second and third switch elements are set to an off state.

3. The source driver of claim 2, wherein the first predetermined period is a period during which a potential of a column terminal of the LCD panel becomes the same level as the reference potential, and the second predetermined period is a period during which the drive voltage supplied to the column terminal of the LCD panel from the output terminal becomes a stable voltage as a voltage according to a gray level which the image data indicates.

4. The source driver of claim 1, wherein current output power of the first output amplifying portion is greater than current output power of the second output amplifying portion.

5. The source driver of claim 1, wherein the predetermined cyclic period is a line scan period of the LCD panel.

6. The source driver of claim 4, wherein each of the plurality of amplifiers is formed as a semiconductor integrated circuit, each of the first and second output amplifying portion includes a plurality of Field Effect Transistors (FETs) having gates arranged in a comb shape, and the current output power of each of the first and second output amplifying portion is determined by the number of FETs.

7. The source driver of claim 1, wherein the inverting portion alternately outputs a first reference voltage, which has a potential higher than the reference potential, corresponding to a gray level of the image data and a second reference voltage, which has a potential lower than the reference potential, corresponding to the gray level of the image data at the predetermined cyclic period for each column of the LCD panel.

* * * * *